US005860259A

United States Patent [19]

Laska

[11] Patent Number: 5,860,259

[45] Date of Patent: Jan. 19, 1999

[54] MASONRY INSULATED BOARD WITH INTEGRAL DRAINAGE

[76] Inventor: Walter A. Laska, 2000 Aldrich Pl., Downers Grove, Ill. 60516

[21] Appl. No.: 895,646

[22] Filed: Jul. 17, 1997

Related U.S. Application Data

[63] Continuation of Ser. No. 517,090, Aug. 21, 1995, which is a continuation-in-part of Ser. No. 441,123, May 15, 1995.

[51] Int. Cl.[6] ..... E04B 7/00

[52] U.S. Cl. ..... 52/302.3; 52/408; 52/404.1

[58] Field of Search ..... 52/169.5, 302.3

[56] References Cited

U.S. PATENT DOCUMENTS

| | | | |
|---|---|---|---|
| 1,732,243 | 10/1929 | Nelson . | |
| 1,853,824 | 4/1932 | Krauss . | |
| 1,867,897 | 7/1932 | Stanbrough . | |
| 2,213,355 | 9/1940 | Woodworth | 72/16 |
| 2,230,702 | 2/1941 | Siebert | 72/22 |
| 3,106,227 | 10/1963 | Crowley | 138/176 |
| 3,441,465 | 4/1969 | Pearson | 161/84 |
| 3,561,177 | 2/1971 | Agro et al. | 52/173 |
| 3,616,130 | 10/1971 | Rogosch | 161/57 |
| 3,638,381 | 2/1972 | Robertson et al. . | |
| 3,654,765 | 4/1972 | Healy et al. | 52/169.5 X |
| 3,677,874 | 7/1972 | Sterrett et al. | 161/116 |
| 3,775,916 | 12/1973 | Bair | 52/125 |
| 3,888,087 | 6/1975 | Bergsland | 52/169.5 X |
| 3,933,546 | 1/1976 | Gohda et al. | 156/71 |
| 3,961,454 | 6/1976 | Adams | 52/527 |
| 4,000,241 | 12/1976 | Dunn . | |
| 4,000,595 | 1/1977 | Fortescue | 52/302.3 |
| 4,045,964 | 9/1977 | Barclay | 52/169.5 X |
| 4,158,275 | 6/1979 | Moore | 52/210 |
| 4,241,555 | 12/1980 | Dickens et al. | 52/454 |
| 4,263,765 | 4/1981 | Maloney . | |
| 4,309,855 | 1/1982 | Pate et al. | 52/169.5 |
| 4,393,635 | 7/1983 | Long | 52/309.11 |
| 4,529,562 | 7/1985 | Connett et al. . | |
| 4,574,541 | 3/1986 | Raidt et al. | 52/169.5 |
| 4,606,169 | 8/1986 | Noon et al. . | |
| 4,622,796 | 11/1986 | Aziz et al. | 52/747 |
| 4,700,512 | 10/1987 | Laska | 52/58 |
| 4,730,953 | 3/1988 | Tarko | 52/169.5 X |
| 4,745,716 | 5/1988 | Kuypers | 52/302.3 X |
| 4,811,537 | 3/1989 | D'Epenoux | 52/385 |
| 4,829,733 | 5/1989 | Long | 52/309.11 |
| 4,840,515 | 6/1989 | Freese | 52/169.5 X |
| 4,852,320 | 8/1989 | Ballantyne | 52/303 |
| 4,869,032 | 9/1989 | Geske | 52/302.3 |
| 4,882,888 | 11/1989 | Moore | 52/309.9 |
| 4,920,716 | 5/1990 | Coffey | 52/386 |
| 4,943,185 | 7/1990 | McGuckin et al. | 52/169.5 X |
| 4,956,951 | 9/1990 | Kannankeril | 52/169.5 |
| 5,044,821 | 9/1991 | Johnsen | 52/169.5 X |
| 5,081,810 | 1/1992 | Emmert | 52/221 |
| 5,092,092 | 3/1992 | Kiekens et al. | 52/403 |
| 5,102,260 | 4/1992 | Horvath et al. | 52/169.5 X |
| 5,230,189 | 7/1993 | Sourlis . | |
| 5,343,661 | 9/1994 | Sourlis | 52/169.5 |
| 5,369,926 | 12/1994 | Borland | 52/302.1 |
| 5,383,314 | 1/1995 | Rothberg | 52/169.5 |
| 5,513,473 | 5/1996 | Sucre | 52/272 |
| 5,598,673 | 2/1997 | Atkins | 52/302.1 |

FOREIGN PATENT DOCUMENTS

| | | |
|---|---|---|
| 90830475 | 10/1990 | European Pat. Off. . |
| 2667338 | 4/1992 | France . |
| 3114323 | 11/1982 | Germany . |
| 347251 | 12/1992 | Japan . |

OTHER PUBLICATIONS

"Introducing ThermaDrain®", *ThermaDrain Inc.®*, brochure.

"ThermaDrain®", *ThermaDrain Inc.®*, brochure.

"Masonry and Steel Detailing Handbook", *Masonry Technologies Incorporated*, Walter Laska, brochure with insert.

"Cavity Walls—Design Gide For Taller Cavity Walls", *Masonry Advisory Council*, 1992, 21 pages.

*Primary Examiner*—Beth Aubrey

*Attorney, Agent, or Firm*—Welsh & Katz, Ltd.

[57] ABSTRACT

An insulated drainage panel for use in cavity wall or veneer wall construction. The insulated panel includes a generally planar insulating board; and a porous structure disposed on one side of the board.

16 Claims, 6 Drawing Sheets

MASONRY INSULATED BOARD WITH INTEGRAL DRAINAGE

This application is a file wrapper continuation of co-pending commonly owned application Ser. No. 08/517,090 filed 21 Aug. 1995, which was a continuation-in-part of co-pending commonly owned application Ser. No. 08/441,123 filed 15 May, 1995.

FIELD OF THE INVENTION

The invention relates to masonry walls and in particular to the insulation of and drainage of moisture from between the exterior wythe and an interior wythe of masonry or associated back-up system.

BACKGROUND OF THE INVENTION

Walls systems having a masonry exterior are typically constructed of at least one vertical layer of masonry and at least a second vertical layer of a material forming a back-up system. The back-up system may be constructed of lumber or of a concrete masonry unit. The brick and back-up system are typically bonded together by horizontal metallic ties spaced 16 inches in a vertical plane. A space is often provided in such wall systems (e.g., cavity wall systems) between the brick and back-up system for moisture drainage. Insulation may also be placed in the space to improve the energy efficiency of masonry buildings.

Masonry offers great durability and appeal. Masonry walls, however, tend to be permeable, allowing water to pass through the wall under certain conditions, such as storms associated with high winds. To solve the water leakage problem, recent construction trends have been towards a masonry wall system where the brick is intentionally separated from the back-up by a small vertical space of from 1–4 inches. When insulation is placed in the space, an effort is made to maintain at least one inch of space between the brick and insulation for drainage.

Masonry walls constructed with a back-up system and intervening drainage space are relatively effective and durable when guidelines are followed and drainage space is maintained. Problems often arise in construction, however, in maintaining an unobstructed space between the brick and associated back-up system. During construction, mortar often falls into the sometimes narrowed drainage space between the brick and back-up or between the brick and insulation, blocking the flow of water out of the wall interior.

In masonry construction using brick exteriors, it is critical to provide proper drainage in the form of a clear cavity within the wall system to prevent water related problems. A proper drainage path allows penetrating water to flow unobstructed to areas of the wall which facilitate drainage back to the exterior.

Normally the 1 to 2 inch air space provided between the brick and back-up system is adequate to provide drainage. However, in addition to mortar entering the air space during the process of brick laying, mortar extruded during the brick-laying process from the outer brick wythe also accumulates in the air space creating blockages, either falling into the air space or simply extending into and blocking the air space. Environmental debris may also fall, or blow, into the air space. Obstructions from these or other sources, either singly or together, may operate to substantially block the flow of water out of portions of the air space.

When blockage of water occurs, freezing of accumulated water inside the wall may cause damage to the wall system.

In masonry construction using brick exteriors, for example, it is especially important to avoid water saturation which upon freezing and thawing may lead to cracking, crazing, spalling and disintegration of masonry structures. Furthermore, penetrating water can cause efflorescence to appear on exterior surfaces or water can be transferred to the interior of the building causing: metal supports to corrode, insulation to lose its effectiveness, interior finishes to deteriorate. Because of the importance of masonry structures in general, a need exists for a better method of ensuring water drainage from within brick walls.

SUMMARY OF THE INVENTION

It is an object of this invention to provide an apparatus for constructing drainage walls that cannot be blocked by construction or environmental debris.

It is a further object of this invention to provide an apparatus for ensuring proper drainage wall construction that is not dependent upon the skill or training of a bricklayer.

Accordingly, these and other objects are provided by an insulated drainage panel for use in drainage wall construction. The insulated drainage panel includes a generally planar insulating board and a porous structure disposed on one side of the board.

DETAILED DESCRIPTION OF A PREFERRED EMBODIMENT

Figure 1:
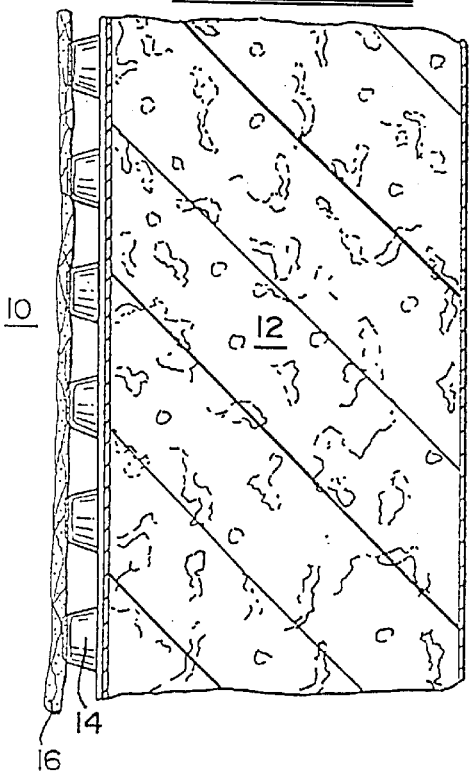
FIG. 1 is a side view of an insulated drainage board fabricated in accordance with an embodiment of the invention.

FIG. 1 is a edge view of an insulated panel 10, generally, in accordance with an embodiment of the invention. The insulated panel 10 is constructed of a insulated section 12 and a planar drain structure 14. The insulated section 12 may be constructed of any self-supporting (rigid) insulating material (e.g., extruded polystyrene, expanded polystyrene, polyisosyanurate, etc.).

The drain structure 14 may be fabricated of a matted material attached to a planar surface of the insulated section 12 by adhesive or otherwise. The matting may be composed of strands of a polymer or copolymer (e.g., high density polyethylene (HDPE), cellulose acetate, polyvinyl chloride (PVC) nylon, polypropylene, polyester, etc.).

The drain section 14 may be attached to the insulated section 12 by rolling or spraying an appropriate adhesive or epoxy onto the insulating board and biasing the drain section 14 into contact with the insulation board 12 until the adhesive or epoxy cures. Where the insulating section 12 is a foamed polymer, the drain section 14 may also be attached to the insulating section 12 during foaming by placing (or floating) the drain section 14 on top of the insulating section 12 during curing of the foamed polymer.

Figure 2A:
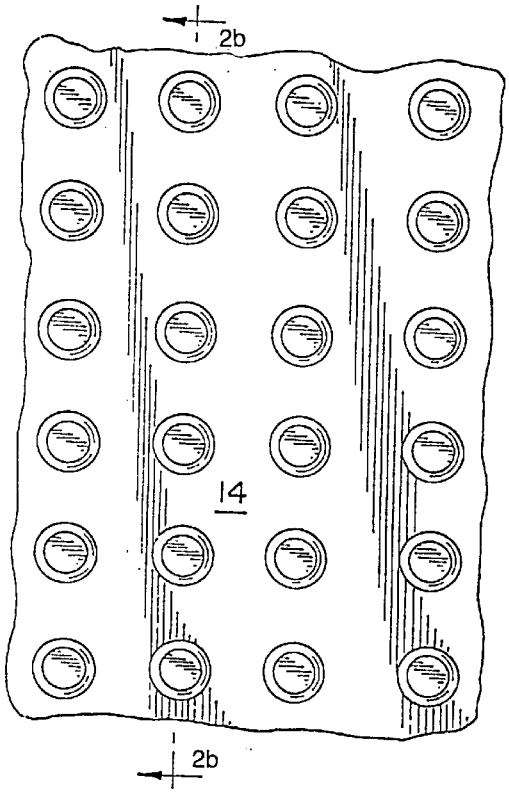
FIGS. 2*a* and 2*b* are front and side views of the porous matting an accordance with FIG. 1.
Figure 2B:
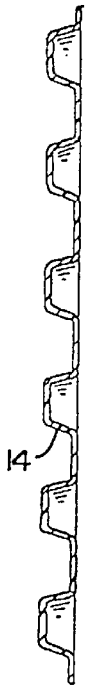

The drain section 14 may also be comprised of a solid plastic material (HDPE) having a "waffle" cross section (FIG. 2). Again, a drain section 14 fabricated of a solid plastic material having a waffle-type cross section may be attached to the insulating board by an appropriate adhesive or epoxy.

Figure 6:
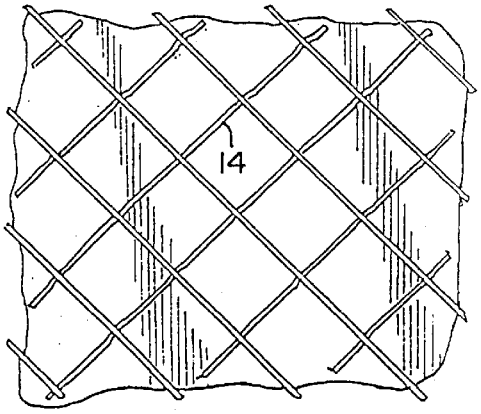
FIG. 6 is a front view of the insulated drainage board of FIG. 1 with a cross-hatched drainage structure formed on the surface of the insulation.

Alternatively, the drain structure 14 may also be formed by scoring or sawing one face of the insulated section 12 into a waffle or cross-hatched pattern (FIG. 6). Where scoring or sawing is used the insulating board would begin with a much thicker panel 12. The drain structure may also be press-formed into the insulating board 12 to form the drainage structure 14 along one side of the board 12.

Figure 11:
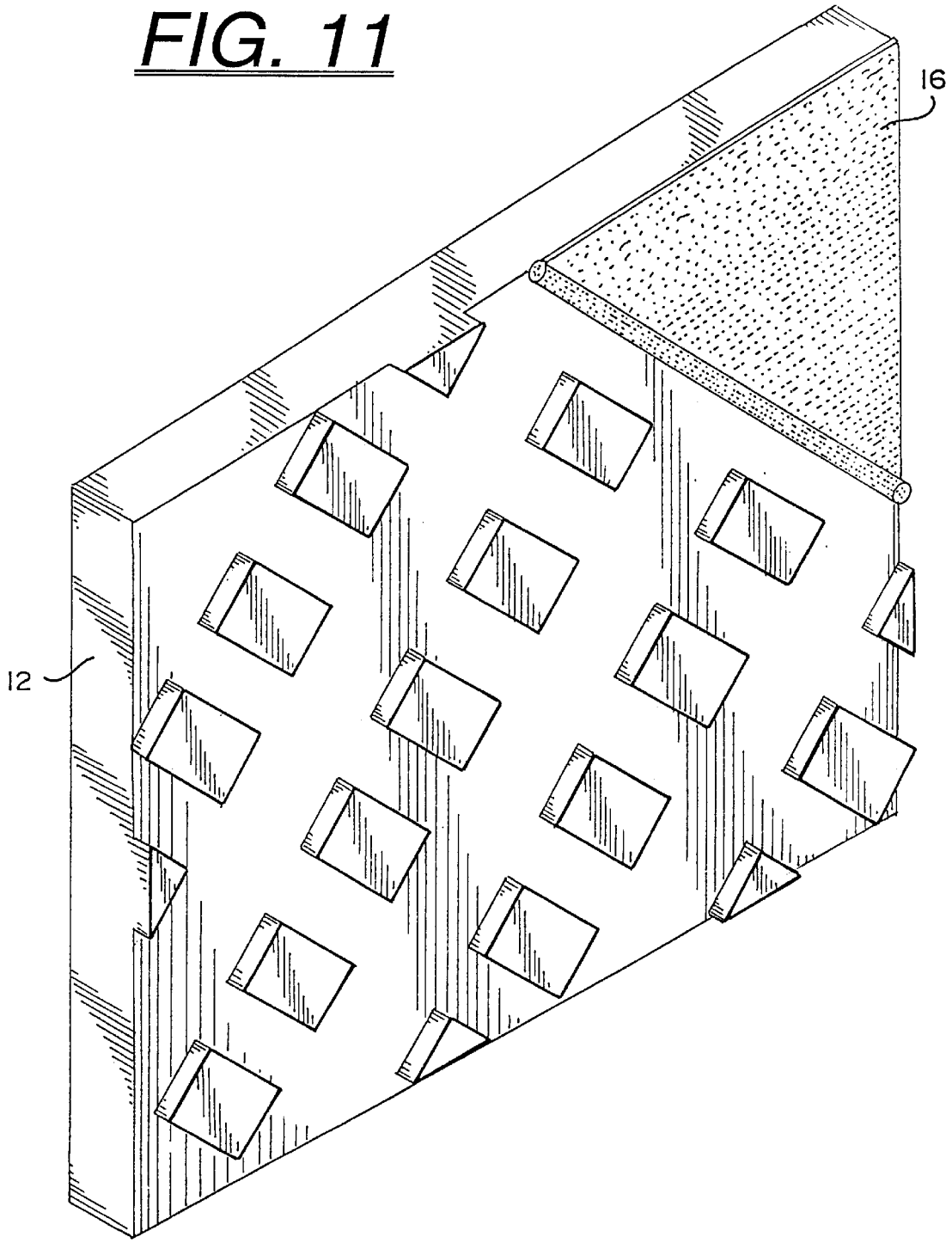
FIG. 11 is a perspective side view of the insulated drainage board of FIG. 1 in accordance with an alternate embodiment.

In a further alternative, the drain structure 14 may be formed by sawing or forming diagonal patterns (instead of the slots of FIG. 6) into the insulation 12. The advantage of the structure of the diagonal patterns (FIG. 11) lies in the open, sloping drainage structure 14 which provides quick drainage by eliminating any horizontal surfaces where water droplets may collect.

The drain section 14 may also have an outer permeable covering 16 of a woven material of screen or mesh (e.g., cotton, polyester, etc.) that functions to prevent mortar from penetrating the drain section. The covering 16 may also be attached to the drain section 14 by an adhesive.

The insulated panel may be used with any drainage wall system. Drainage wall systems contemplated under the embodiment include cavity wall systems and veneer wall systems.

Figure 3:
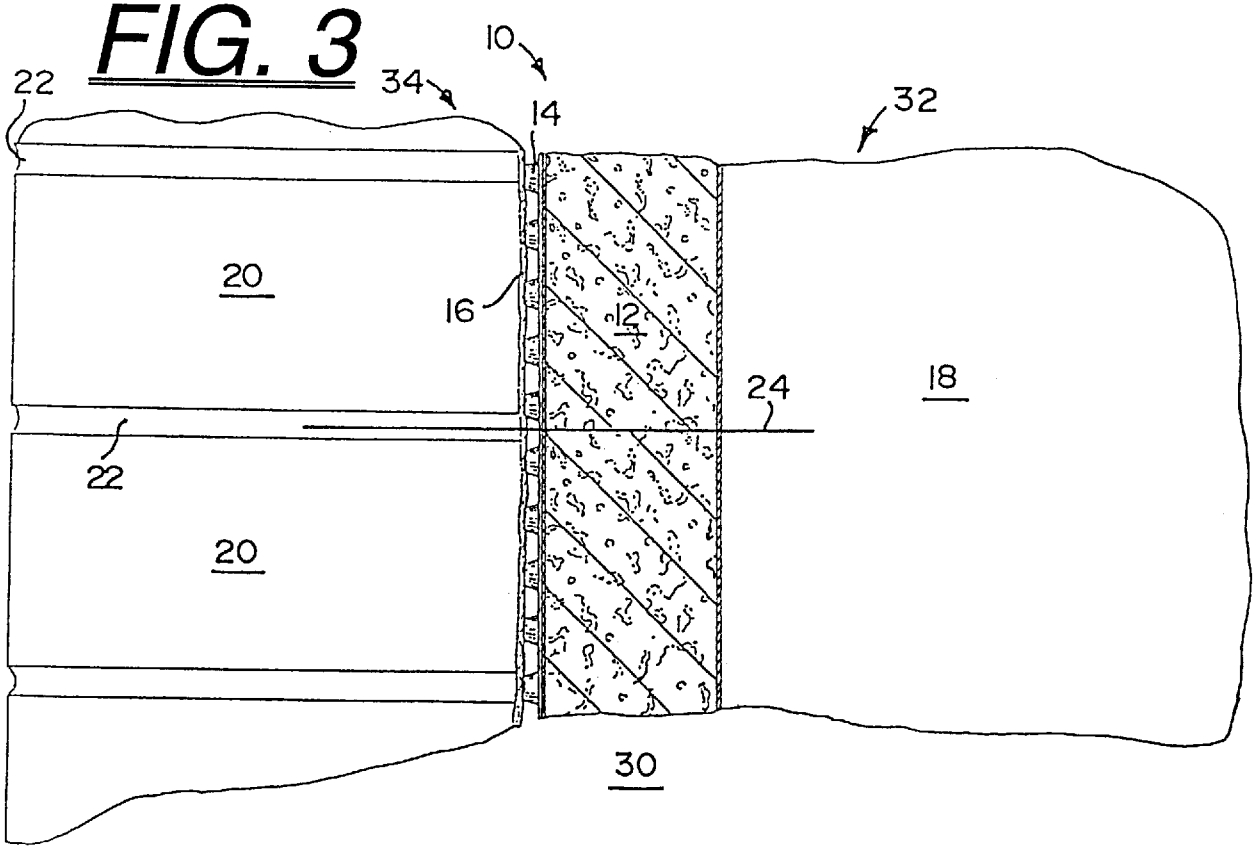
FIG. 3 a side view of a wall system using the insulated board of FIG. 1.

During construction of a drainage wall system 30 (e.g., masonry wall system) (a cross section of which is shown in FIG. 3) the insulated panel 10 is placed against the back-up system 32, with the drain section 14 of the insulated panel 10 facing away from the back-up system 32. The brick 20 and mortar 22 of the outer masonry wythe 34 may then be placed against the drainage section 14 of the insulated board 10 without fear of blocking water flow. The drainage section 14 ensures the proper construction of drainage wall systems by providing a positive stop for mortor extended from the outer wythe of masonry.

The resilient loft of the drainage section 14 prevents the brick and mortar 20 from compressing the drain section 14 and blocking the vertical water flow through the drain section 14. The loft of the drainage section 14 ensures the porosity of the drain section to water flow under all conditions. The density of the matting 14 (or the optional covering 16) prevents the mortar 22 (extruded during the brick-laying process) from penetrating the drain section 14 or interfering with the porosity of the drain section 14 thereby allowing for the free flow of water both vertically and laterally.

Cross ties 24 (or wall ties) may pass through the insulating board 10 at regular vertical intervals (e.g., 16 inches). Under one embodiment, the insulating board 10 is constructed in a planar size of 8 foot by 16 inches and during wall assembly is placed to fit between the cross ties 24. Alternatively, the insulating board 10 may be made larger with anchor fasteners, protruding through the insulated drainage board and into the back-up system without substantially interfering with the vertical flow of water.

Following construction of the masonry wall 30, the drain section 14 of the insulating board 10 provides a continuous drainage path for water from a top of the finished wall 30 to a wall base or horizontal intersection (e.g., shelf angles, lintels, etc.). Weep holes and a flashing membrane (constructed as provided under the prior art) provide a means for the water to exit.

Under the embodiment, the back-up system (i.e., support wall or structural wall) 32 of the masonry wall 30 may be fabricated of wood, steel, concrete masonry unit, or concrete. The use of the novel insulating panel 10 in the wall system 30 ensures the proper construction of drainage wall system by providing a porous drainage path in both vertical and horizontal direction that cannot be blocked by improper or careless construction practices. In doing so the insulating panel 10 ensures proper interior wall drainage for drainage wall systems in a manner that is both convenient and easy to use.

Figure 4:
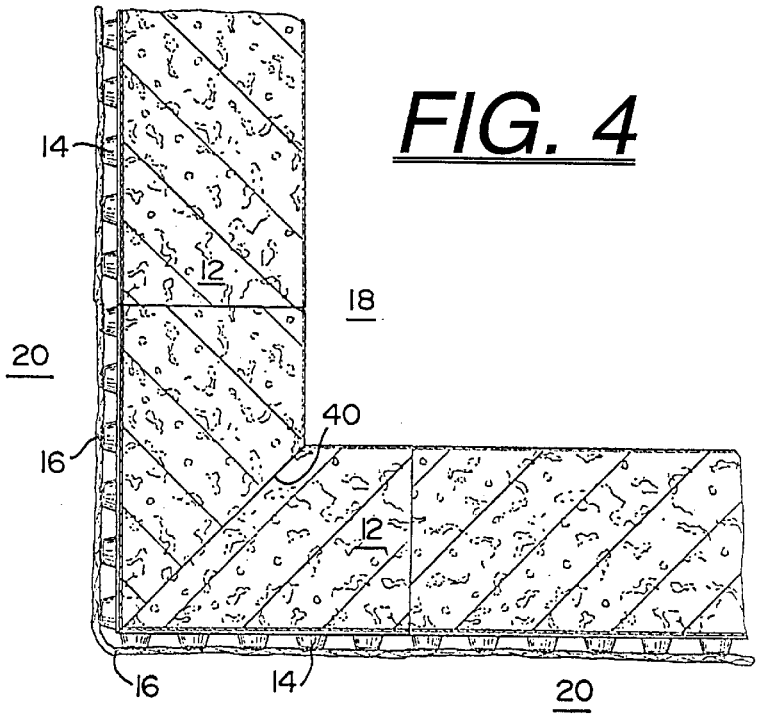
FIG. 4 is a top view of the insulated drainage board of FIG. 1 mitered for use on an outside corner.
Figure 5:
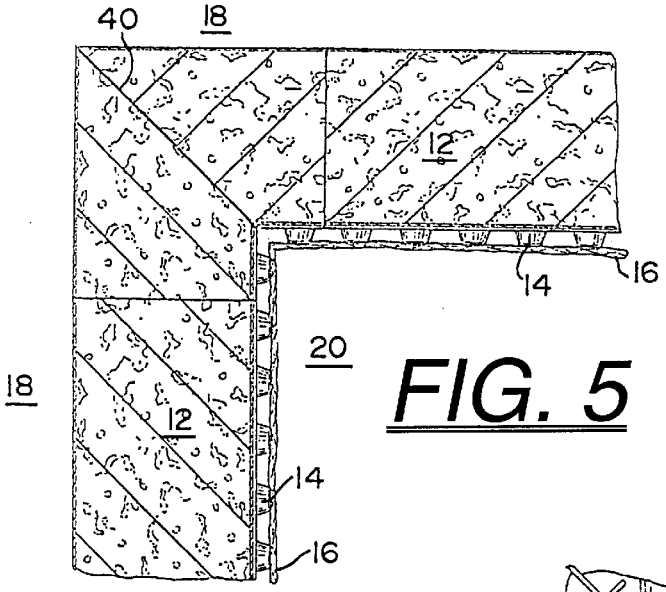
FIG. 5 is a top view of the insulated drainage board of FIG. 1 mitered for use on an inside corner.
Figure 8:
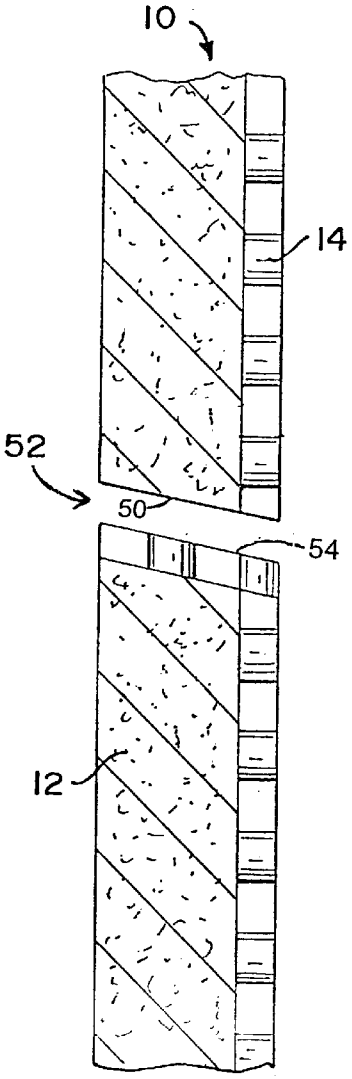
FIG. 8 is a side view of the insulated drainage board of FIG. 1 in accordance with an alternate embodiment.
Figure 7:
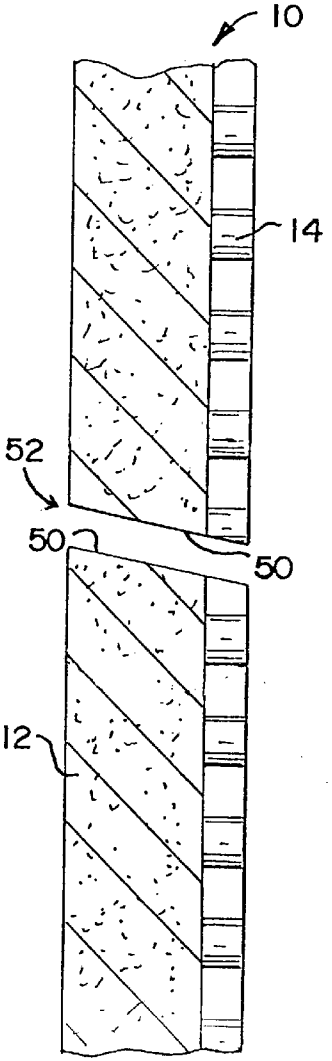
FIG. 7 is a side view of the insulated drainage board of FIG. 1 in accordance with an alternate embodiment.

In another embodiment the benefits of the insulating board 10 may be enhanced by providing a continuous insulating and drainage structure around the exterior of a building. The edges of the insulating board 10 may be mitered 40 (FIGS. 4 and 5) for extending around outside and inside corners of the wall 30. Again, mitering may be accomplished by cutting or forming.

Where insulating boards 10 are arranged vertically, and side by side, on a wall, provision may also be made to prevent water penetration at the joints 52 between insulating boards 10. To prevent water penetration (FIG. 7), the top and bottom edges of each board 10 are sloped downwards from the insulating section 12 (installed adjacent the backup system 32) towards the drainage section 14 along a beveled edge 50 of the board 10 to form a mitered joint. The joint between vertically adjacent boards 10 may be formed by butting the beveled edge 50 of top and bottom board 10 in close proximity. Alternatively, a layer of the drainage structure 14 may be overlapped across the top of the bottom board 10 as designated by the reference number 54 in FIG. 8.

Figure 10:
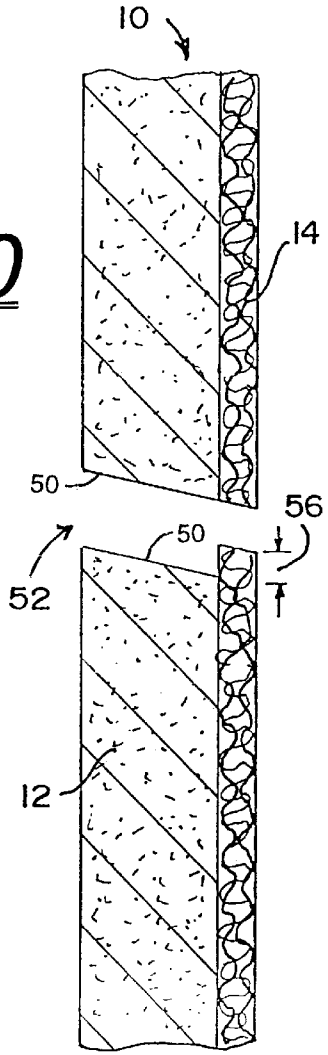
FIG. 10 is a top view of the insulated drainage board of FIG. 1 in accordance with an alternate embodiment.
Figure 9:
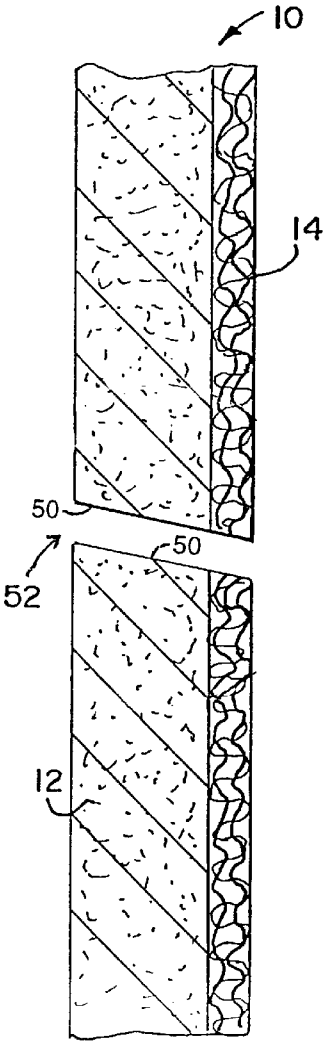
FIG. 9 is a top view of the insulated drainage board of FIG. 1 in accordance with an alternate embodiment.

To prevent water penetration in vertical joints FIGS. 9 and 10, the beveled edges 50 of FIG. 9 may be used to increase the horizontal distance that water must travel before reaching the support wall 32 (as shown in FIG. 9) or a short length 56 of drainage structure 14 may be extended past one horizontal end of the board 10 (FIG. 10) to provide a preferential flow path for water to follow.

Inclusion of the short length 56 causes a small gap to exist between horizontally adjacent boards 10. The gap prevents water from spanning the insulating section 12 by capillary action.

Incorporating the drainage path into an insulating panel ensures an energy efficient wall 30 while facilitating assembly and stability during constructure of the wall. A specific embodiment of novel methods and apparatus of ensuring proper drainage of drainage walls according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. A laminated insulated drainage panel, for installation between a backing wall and an exterior masonry wall of a masonry drainage wall system, the panel comprising: a generally planar insulating layer; and a porous layer disposed on one side of the insulating layer; the panel having mitered edges; wherein the panel may be installed in the wall system with the insulating layer adjacent the backing wall, and with the porous layer between the insulating layer and the exterior masonry wall for providing a vertical drainage path within the drainage wall system.

2. The insulated panel as in claim 1 wherein the porous layer further comprises a waffle structure.

3. The insulated panel as in claim 1 wherein the porous layer is further comprised of a woven mesh of high density polyethylene strands.

4. The insulated panel as in claim 1 wherein the porous layer is further comprised of one of the group including high density polyethylene, cellulose acetate, polyester, nylon and polyethylene terephthalate.

5. The insulated panel as in claim 1 wherein the porous layer is further comprised of a cross-hatched pattern of slots formed in a surface of the generally planar insulating layer.

6. The insulated panel as in claim 1 further comprising a woven porous material, corrosion resistant screen or mesh cloth disposed over the porous layer.

7. The insulated panel as in claim 1 wherein the insulating layer further comprises polystyrene.

8. The insulated panel as in claim 1 wherein the insulating board further comprises polyisosyanurate.

9. The insulating panel as in claim 1 further comprising a strip of the porous layer disposed along an edge of the laminated drainage panel.

10. An above-ground drainage wall system comprising:

an outer masonry wythe;

an interior back-up system separated from the outer wythe by an air space or cavity; and an insulated drainage panel disposed substantially throughout the air space between the interior back-up system and the outer wythe for excluding mortar from entering the space between the interior back-up system and the outer wythe during construction of the drainage wall system and for providing a continuous vertical drainage path after construction;

wherein the insulated drainage panel comprises a plurality of insulated drainage boards, each board having horizontal and vertical edges, the edges of adjacent boards aligned so that the panel is disposed substantially throughout the air space; and wherein the horizontal adjacent edges of the boards are beveled sloping towards the outer wythe.

11. The wall system as in claim 10 wherein the drainage panel further comprises polyethylene matting.

12. The wall system as in claim 10 further comprising a woven cloth disposed between the drainage panel and the outer wythe of masonry.

13. The wall system as in claim 10 wherein the insulated drainage panel further comprises:

a planar sheet of insulation with a first side of the planar sheet of insulation disposed adjacent the interior back-up system; and a planar drain section disposed adjacent the outer wythe on a second side of the planar sheet of insulation.

14. The wall system as in claim 10 wherein each of the boards further comprises:

a planar sheet of insulation with a first side of the planar sheet of insulation disposed adjacent the interior back-up system; and a planar drain section disposed adjacent the outer wythe on a second side of the planar sheet of insulation; and wherein the panel further comprises a layer of the planar drain section disposed between the horizontal adjacent edges of the boards.

15. The wall system as in claim 10 wherein the vertical adjacent edges of the boards are beveled.

16. In a masonry drainage wall system including a backing wall, an exterior masonry wall, and a cavity formed between the backing wall and the exterior masonry wall, the improvement comprising: a laminated insulated drainage panel, with a generally planar insulating layer and a porous layer disposed on one side of the insulating layer, wherein the panel may be installed in the cavity with the insulating layer adjacent the backing wall, and with the porous layer between the insulating layer and the exterior masonry wall for providing a vertical drainage path within the drainage wall system; wherein the insulated drainage panel comprises a plurality of insulated drainage boards, each board having horizontal and vertical edges, the edges of adjacent boards aligned so that the panel is disposed substantially throughout the cavity; and wherein the adjacent edges of the boards are beveled and the horizontal edges slope down towards the exterior masonry wall.

* * * * *